United States Patent [19]

Madigan

[11] 3,949,671

[45] Apr. 13, 1976

[54] SYSTEM FOR TRANSPORTING INKED PAPER FROM A PRINTING STATION TO A STACKER STATION BY MEANS OF PRESSURIZED AIR

[75] Inventor: Thomas M. Madigan, Pittsford, N.Y.

[73] Assignee: ITEK Corporation, Lexington, Mass.

[22] Filed: Dec. 27, 1974

[21] Appl. No.: 537,018

[52] U.S. Cl. ..... 101/232; 271/174; 271/188

[51] Int. Cl.[2] ..... B65H 29/54; B65H 29/70

[58] Field of Search ..... 271/DIG. 2, 80, 174, 188, 271/195, 209, 272, 273, 274; 101/232, 420; 118/245

[56] References Cited

UNITED STATES PATENTS

| | | | |
|---|---|---|---|
| 708,958 | 9/1902 | Cowan | 271/209 |
| 2,408,498 | 10/1946 | Welk | 271/80 |
| 2,811,920 | 11/1957 | Richardson | 271/195 |
| 3,334,897 | 8/1967 | Sharkey | 271/195 |

*Primary Examiner*—Evon C. Blunk
*Assistant Examiner*—Robert Saifer
*Attorney, Agent, or Firm*—Homer O. Blair; Robert L. Nathans; Gerald H. Glanzman

[57] ABSTRACT

A printing station including an impression cylinder and a plate cylinder is positioned adjacent an air applicator which causes paper emerging from the nip of the cylinders to be pressed against an arcuate portion of the impression cylinder so as to be driven over a paper guide means which forwards the paper to a stacking station. Drive means are also included adjacent the guide means, consisting of a pair of beveled rollers which produce stiffening of the paper to give it rigidity along its length in order to support the paper in cantilever fashion as it passes from the drive means to the stacker. The air applicator is designed to produce some air travel in the direction of motion of the inked paper to assist in driving the paper and drying the ink.

1 Claim, 3 Drawing Figures

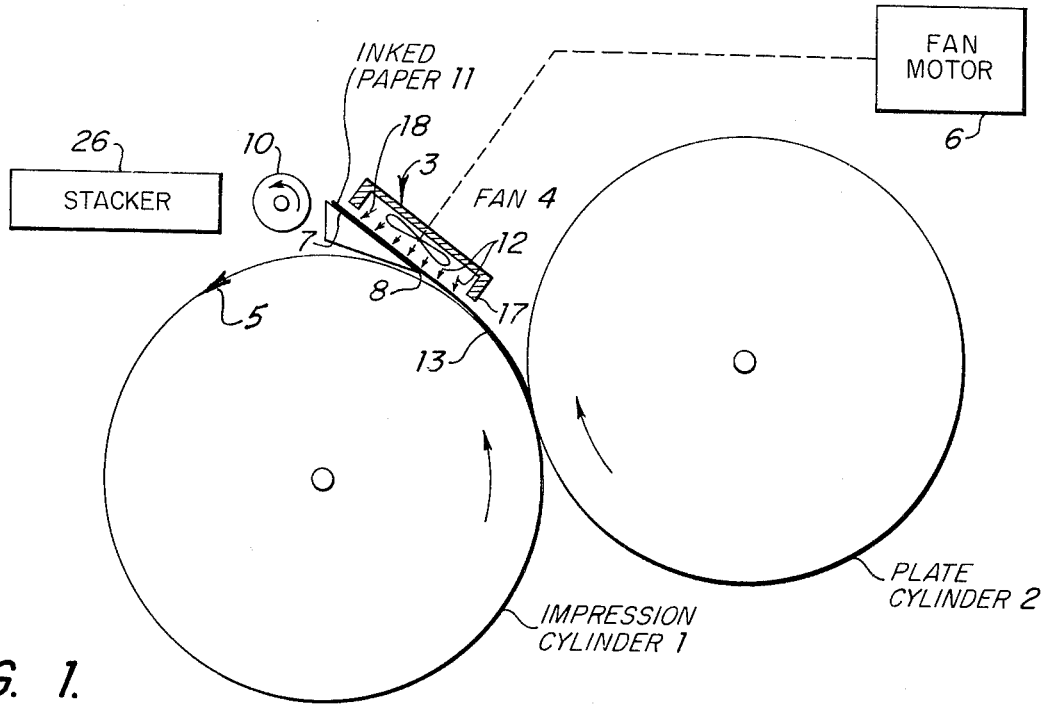
FIG. 1.
FIG. 2.
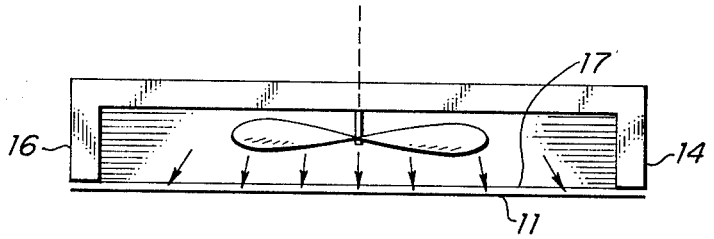
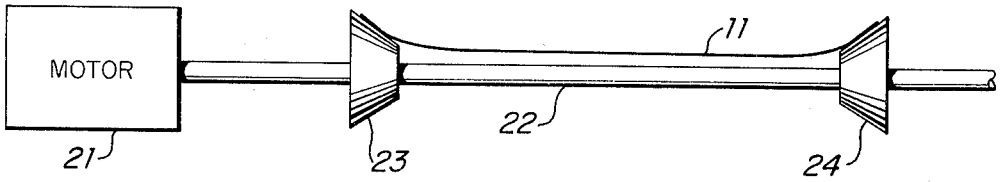
FIG. 3.

SYSTEM FOR TRANSPORTING INKED PAPER FROM A PRINTING STATION TO A STACKER STATION BY MEANS OF PRESSURIZED AIR

BACKGROUND OF THE INVENTION

It has been found desirable to eliminate conventional roller pairs for transporting inked paper from the printing station to the stacking station of a duplicator machine because conventional rollers accumulate ink, particularly with respect to bleed edge printing. The accumulation of the ink may thereafter produce a darkened line along the edges of the paper which is undesirable.

SUMMARY OF THE INVENTION

In accordance with a preferred embodiment of the invention, the above-mentioned conventional drive rollers are eliminated by employing an air applicator adjacent the interface between the impression cylinder and the plate cylinder, which applicator enables the impression cylinder to drive the paper to a pair of beveled rollers which cause the paper to be bowed thereby to induce rigidity into the paper to aid in its transportation to the stacker. Since the inked surface is not in contact with drive rollers, the problem of ink accumulation on the drive rollers has been eliminated. The air applicator is configured to cause some of the air to move in a direction parallel to the direction of travel of the paper to aid in the transportation thereof over a paper guide means intermediate the cylinder and the beveled rollers.

Other objects, features and advantages of the present invention will become apparent from perusal of the following description taken in conjunction with the drawings in which:

FIG. 1 illustrates a side view of the preferred embodiment;

FIG. 2 illustrates a front view of the air applicator; and

FIG. 3 illustrates a front view of the beveled roller drive means.

DETAILED DESCRIPTION

In FIG. 1, impression cylinder 1 is illustrated in contact with plate cylinder 2. An air applicator 3 containing a fan 4 is positioned adjacent the nip between the cylinders 1 and 2. Fan 4 is driven by fan motor 6. Paper guide means 7 is schematically illustrated as a wedge having a tip portion 8 which is positioned closely adjacent the surface of cylinder 1. Guide means 7 could take any conventional form and could comprise parallel wires or flat strips laid out in a direction parallel to the direction of travel of inked paper 11 positioned as indicated. Arrows 12 illustrate the direction of air which impinges generally normal to the surface of the paper along arcuate cylinder portion 13. Owing to the coefficient of friction between the paper and impression cylinder 1, a tangential drive force is produced along cylinder portion 13 to cause the paper to be driven up wire guide 7. A leading edge gripper 5 releases the paper in the conventional manner to enable it to be driven up paper guide 8.

In FIG. 2, the air applicator is illustrated having side wall or baffle portions 14 and 16 for containing the air and for preventing substantial quantities from leaking out of the sides of the applicator. A tail baffle 17 is also present which together with baffles 14 and 16 causes most of the air to be driven in a direction indicated by arrows 18 in FIG. 1. In other words, a certain portion of the air travels in a direction parallel to the direction of paper travel and assists somewhat in the transportation of the paper up the guide 7. The impingement of the air along the length of the paper also aids somewhat in speeding up the drying of the ink wich reduces the chance of smudging in the stacker, particularly in cases where the paper is somewhat over inked.

FIG. 3 illustrates a front view of paper drive means 10. Motor 21 causes rotation of drive shaft 22 bearing beveled rollers 23 and 24, which rollers receive sheet 11 as illustrated. The upper beveled roller portions support the paper and cause it to be somewhat bowed as shown. This bowing produces rigidity along the direction of travel of the paper so that it does not "flop over" before arriving at the stacker station 26.

In summary, the paper transport system of the present invention completely eliminates roller contact between inked portions of the driven paper, in order to prevent accumulation of ink upon such rollers. An air applicator is employed in a manner to cause the paper to be driven by the impression cylinder and also somewhat by the air itself which air also functions to assist in the drying of the inked surface. Beveled rollers are employed in the preferred embodiment to support paper at the uninked portions thereof, and further to transport such paper to the stacker station.

While preferred embodiments of the invention have been described, the teachings of this invention will readily suggest many other embodiments to those skilled in the art.

What is claimed is:

1. In a duplicating device, a paper transport system for transporting bleed edge inked paper from a printing station to a stacking station, said printing station including a plate cylinder and an impression cylinder, said paper being driven over a portion of said impression cylinder comprising:

a. air applicator means which causes air to be directed downwardly over said paper in the neighbor of said impression cylinder, and additionally in the direction of travel of said paper, to cause said paper to be pressed against said portion of said impression cylinder and to be driven thereby;

b. paper guide means for causing said paper to leave the surface of said impression cylinder; and c. drive means adjacent said paper guide means and including a pair of beveled rollers positioned upon a common drive shaft for allowing said paper to bow and thereby be stiffened in a direction perpendicular to the width thereof to facilitate transportation of said paper to said stacking station inked side up to prevent physical roller contact.

* * * * *